US005353040A

United States Patent [19]

Yamada et al.

[11] Patent Number: 5,353,040

[45] Date of Patent: Oct. 4, 1994

[54] 4-WIRE HELICAL ANTENNA

[75] Inventors: Kenichi Yamada; Yujiro Taguchi, both of Kanagawa, Japan

[73] Assignee: Toyo Communication Equipment Co., Ltd., Samukawa, Japan

[21] Appl. No.: 109,001

[22] Filed: Aug. 16, 1993

Related U.S. Application Data

[63] Continuation of Ser. No. 761,357, Sep. 9, 1991, abandoned.

[30] Foreign Application Priority Data

Jan. 8, 1990 [JP] Japan ..... 2-1231
Oct. 1, 1990 [JP] Japan ..... 2-263331
Nov. 21, 1990 [JP] Japan ..... 2-319689

[51] Int. Cl.[5] ..... H01Q 11/08; H01Q 1/36; H01Q 17/00

[52] U.S. Cl. ..... 343/895; 343/897

[58] Field of Search ..... 343/895, 897, 909; 342/1-4; H01Q 17/00, 11/00, 11/01, 11/02, 11/03, 11/04, 11/05, 11/06, 11/07, 11/08

[56] References Cited

U.S. PATENT DOCUMENTS 3,503,075 3/1970 Gerst ..... 343/895
3,906,509 9/1975 DuHamel ..... 343/895
4,169,267 9/1979 Wong et al. ..... 343/895
4,697,192 9/1987 Hofer et al. ..... 343/895
5,134,422 7/1992 Auriol ..... 343/895

FOREIGN PATENT DOCUMENTS 0000849 1/1966 Japan .
0097353 8/1979 Japan ..... 343/895
0099006 1/1982 Japan ..... 343/895
0141802 8/1984 Japan ..... 343/742

OTHER PUBLICATIONS

Wong et al., Broadband Quasi-Taper Helical Antennas, IEEE Trans, on Ant. & Prop., vol. AP27, No. 1, Jan., 1979, pp. 72-78.

*Primary Examiner*—William Mintel
*Assistant Examiner*—Peter Toby Brown
*Attorney, Agent, or Firm*—Fish & Richardson

[57] ABSTRACT

The first embodiment is a 4-wire fractional-winding helical antenna in which a spiral conductor pattern is formed easily and precisely on the surface of a supporting member in the form of a cylindrical tube or a stepped cylindrical tube form by the photoetching technology. This 4-wire fractional-winding helical antenna has improved characteristics, in particular broader frequency bandwidth. Further, it can solve the problems with the winding of the helical conductors. The second embodiment is an antenna unit in which a shield plate is provided between the antenna and coupling and conversion circuits, the antenna-side face of the shield plate is coated with a material for absorbing electromagnetic waves, and the antenna plate comprises an aluminum or copper plate and a layer of ferrite on the antenna-side face of the aluminum or copper plate. This antenna unit can prevent the reflection by the components at the antenna base and the airframe of the electromagnetic wave from the antenna and hence deterioration of the directivity pattern.

3 Claims, 12 Drawing Sheets

4-WIRE HELICAL ANTENNA

This application is a file wrapper continuation of U.S. application Ser. No. 07/761,357, filed Sep. 9, 1991, now abandoned.

FIELD OF THE INVENTION

The present invention relates to a 4-wire fractional-winding helical antenna (Quadrifilar Helix Antenna) whose helical conductors can be formed easily and precisely by the photoetching technology and to the method for manufacturing it. The present invention also relates to a 4-wire fractional-winding helical antenna unit which can prevent the decrease of the gain and the deterioration of the directivity caused by the effect of the reflected wave by the components at the antenna base.

PRIOR ART

A 4-wire fractional-winding helical antenna has been attracting attention as an antenna used in communication systems using geostationary or non-stationary satellites and is used widely.

FIG. 11 is a sectional view showing a 4-wire fractional-winding helical antenna unit heretofore used in such communication systems.

The antenna unit comprises a balun 103 mounted on a base plate 101, an antenna 104 supported above the balun 103 and a hybrid circuit 105 (HYB) located below the base plate 101 and is housed in a radome 102 secured to the base plate 101.

The antenna 104 comprises a mylar member 106 formed in a cylinder and two antenna elements 107 and 108 helically wound around the mylar member 106 as shown in FIG. 12. The bottom ends of these antenna elements 107 and 108 are connected to four terminals of the balun 103.

The balun 103 is a part for an unbalanced-balanced conversion between the hybrid circuit 105 and each antenna element 107, 108, whose bottom terminals are connected to the hybrid circuit 105 by means of a coaxial cable passed through the base plate 101.

The hybrid circuit 105 generates two signals with a predetermined phase difference fed from a transceiver in an aircraft to send them to the balun 103, and combines the signals fed from the antenna via the balun 103 to send the resultant signal to the transceiver.

However, the frequency bandwidth of the above cylindrical 4-wire fractional-winding antenna 104 is not sufficiently broad for simultaneous transmission and reception through two separate frequency bands with one antenna as shown in FIGS. 13 (*b*) and (*c*).

FIG. 13 (*a*) shows the dimensions of the above single-cylinder 4-wire fractional-winding antenna 104. FIGS. 13 (*b*) and (*c*) show the standing wave ratio (SWR) measured at each of the two input terminals of the balun 105.

The antenna of this example has the dimensions as shown in FIG. 13 (*a*) and its antenna elements (conductor pattern on the side surface of the mylar member) are formed so that the antenna can be used for two frequency bands 1.53 to 1.56 GHz and 1.63 to 1.66 GHz.

The frequency characteristics of the SWRs measured at the two input terminals of the balun are different due to manufacturing errors, variation in the quality of the material and other causes, though it is desired that they are identical.

Since the synthetic characteristic of an antenna is greatly affected by SWR, the upper limit of SWR is generally 1.5 for an antenna being practically usable.

The conventional antenna in FIG. 13 (*a*) is not satisfactory from this aspect, because the SWR of the above conventional antenna exceeds the desirable limit, that is, the SWR in FIG. 13 (*b*) is 2.2 at 1.66 GHz and that in FIG. 13 (*c*) is 1.8 at 1.66 GHz. The conventional 4-wire fractional-winding helical antenna thus has a problem that the frequency bandwidth is not sufficiently broad.

Further, as the spiral antenna elements 107 and 108 are formed by winding narrow strips cut from a metal sheet such as copper around a cylindrical mylar member 106, it takes much time and labor to manufacture the antenna 104, hindering a cost reduction.

Furthermore, since the dimensional accuracy of the antenna 104 is directly affected by the skill of workers, this method for forming the antenna elements is not suited to a mass production, and has problems such as a low yield rate of products due to the difficulty in maintaining a uniform dimensional accuracy and a low product value due to a poor appearance.

A possible method to solve the above problems is sticking a copper foil on a cylindrical mylar member 106 and etching it.

With the current etching technique, however, it is difficult to form a required precise pattern on a curved surface.

The formation of a pattern is particularly difficult for the antenna of the present invention described below which has a four fractional-winding antenna pattern formed on the cylindrical surface of a member made of Teflon or other resins with the upper and lower cylindrical parts of different diameters connected by a tapered step surface.

The first object of the present invention is to improve the characteristics of the conventional 4-wire fractional-winding helical antenna, particularly to extend the usable frequency bandwidth and to solve the problems with the formation of the helical conductors. The present invention thereby provides a 4-wire fractional-winding helical antenna whose helical conductors can be formed easily and precisely on a cylindrical or stepped cylindrical member and method for manufacturing it.

When a 4-wire fractional-winding helical antenna is installed on an airframe 100 of an aircraft as shown in FIG. 14, the gain in the perpendicular direction of the radiation pattern lowers as shown in FIG. 15 to cause the deterioration of the directional pattern of the whole antenna unit. The gain varies according to the direction and FIG. 15 shows the maximum gain with an outer line and the minimum gain with an inner line for simplicity. It is known from the diagram that the difference between the inner radiation pattern P1 connecting the minimum gain in each direction and the outer radiation pattern P2 connecting the maximum gain is comparatively large while the gain itself is comparatively small. The cause of the deterioration of the characteristics is thought to be the reflection of a part of the electromagnetic wave radiated from the antenna 104 by the metal base plate 101 and the airframe 100 as shown in FIG. 14.

Further, the electromagnetic wave from the antenna enters the balun and the hybrid circuit to interfere with their operation, causing the increase of SWR and the deterioration of the directional pattern which result in the lowering of the antenna efficiency.

Therefore, the second object of the present invention is to provide an antenna unit using a 4-wire fractional-winding helical antenna which can prevent the reflection by the antenna base and the airframe of the electromagnetic wave from the antenna to retain a nearly ideal radiation pattern and thus can prevent the deterioration of the directivity.

DISCLOSURE OF THE INVENTION

To solve the above problems, the 4-wire fractional-winding helical antenna as the first embodiment of the present invention is characterized in that a conductor pattern is formed on the surface of an antenna supporting member made of a cylinder or cylindrical tube or a stepped cylinder or cylindrical tube with a plurality of cylinders or cylindrical tubes of different diameters connected coaxially, and the supporting member has tapered surfaces connecting the surfaces of the cylinders or cylindrical Lubes or the top end portion of the supporting member is tapered.

The method of forming the conductor pattern of a 4-wire fractional-winding helical antenna on the surface of a supporting member made of a cylinder or cylindrical tube or a stepped cylinder or cylindrical tubes with a plurality of cylinders or cylindrical tubes of different diameters connected axially is characterized by depositing a metal layer in a uniform thickness on the surface of the supporting member, applying a photoresist over the metal layer, fitting a mask closely on the supporting member and removing the mask after exposing the photoresist to light through transparent parts in the form of a conductor pattern of the mask, and removing unexposed photoresist and then the metal layer under the unexposed photoresist.

The mask for forming the conductor pattern of a 4-wire fractional-winding helical antenna is a tubular case which has transparent helical pattern formed in an opaque ground and fits closely to the surface of the supporting member.

The antenna unit as the second embodiment of the present invention is characterized in that a shield plate is displaced between a 4-wire fractional-winding helical antenna and coupling and conversion circuits, the shield plate is made of aluminum or copper, and the antenna-side of the shield plate is coated with a wave absorbing material such as ferrite.

DETAILED DESCRIPTION OF THE PREFERRED EMBODIMENTS

Hereinafter described in detail are preferred embodiments of the present invention with reference to the drawings.

Figure 1:
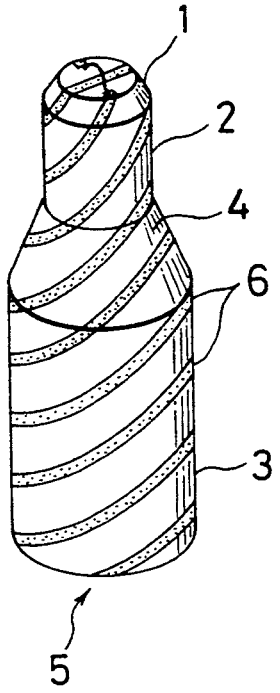
FIG. 1 is a perspective view of an embodiment of the 4-wire fractional-winding helical antenna of the present invention.

FIG. 1 is a perspective view of the first embodiment of the 4-wire fractional-winding helical antenna element of the present invention.

In the embodiment shown in this Figure, four conductors 6*a* through 6*d* are formed around the surface of an antenna supporting member 5 made by coaxially connecting a first cylindrical portion 2 with a tapered portion 1 formed by cutting the corner around the top end, a second cylindrical portion 3 of a greater diameter, and a second tapered portion 4 between the cylindrical portions 2 and 3. This embodiment is characterized in that the antenna supporting member 5 has the two cylinder portions of different diameters connected coaxially in a stepped cylinder and has tapered portions at the top and between the two cylindrical portions. Although the reason is not yet completely elucidated in detail, the antenna of this embodiment has a broader band width than the conventional 4-wire fractional-winding helical antenna.

Figure 2:
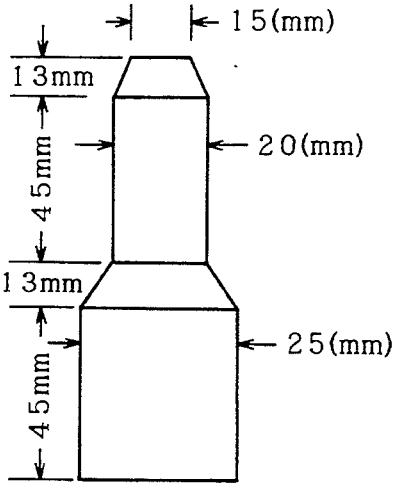
FIGS. 2 (*a*), (*b*) and (*c*) show the dimensions of the 4-wire fractional-winding helical antenna of the embodiment and the result of measurement.
Figure 2:
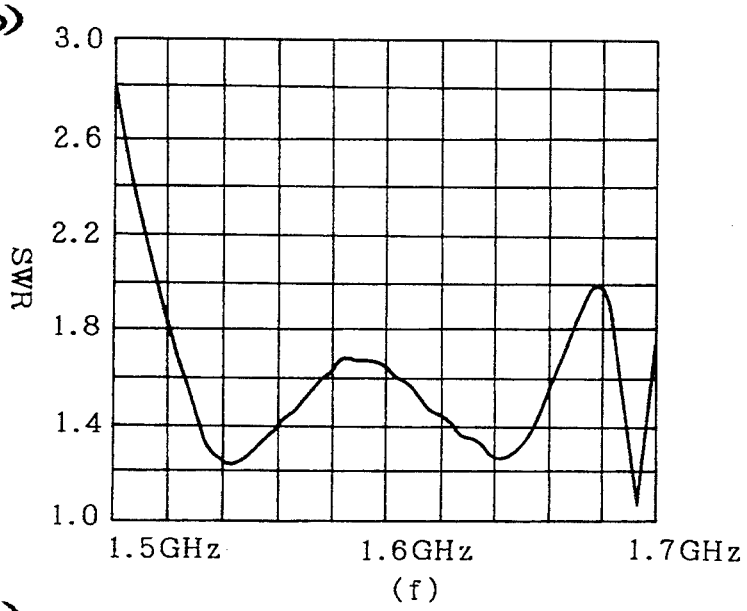
Figure 2:
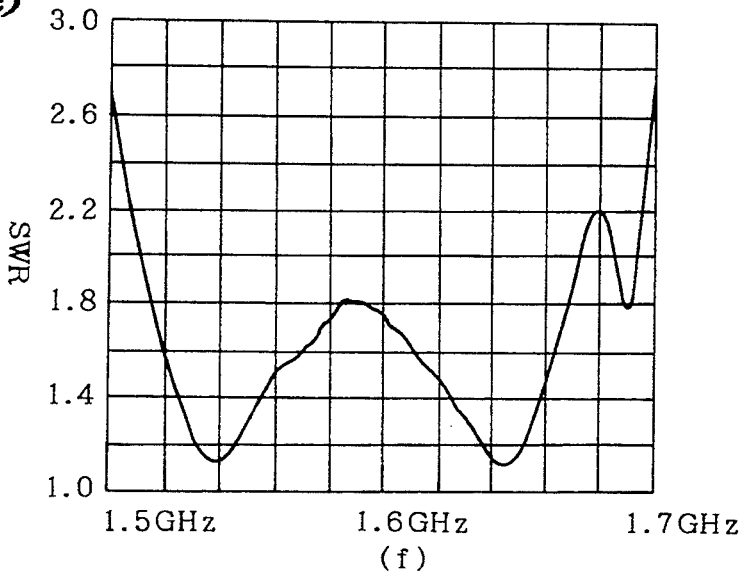

FIGS. 2 (*a*) , (*b*) and (*c*) show the dimensions and measured results of the first embodiment. The diameters of the upper and lower cylindrical portions 2 and 3 are 20 mm and 25 mm respectively and other dimensions are as shown in FIG. (*a*). Further, the conductor pattern is so formed that SWRs are equal to or smaller than 1.5 over the frequency bands of 1.53 to 1.56 GHz and 1.63 to 1.66 GHz. FIGS. 2 (*b*) and (*c*) show the frequency characteristic of the VSWRs measured at the two input terminals of the balun. By comparing the characteristics in FIGS. 2 (*b*) and (*c*) with those of a conventional antenna shown in FIGS. 13 (*b*) and (*c*), an improvement of the characteristic of this embodiment is noticeable.

That is, the SWRs in FIGS. 2 (*b*) and (*c*) are both below 1.5 throughout the desired frequency ranges.

Not only the form as shown in FIG. 1 but also other various modified forms have a similar effect of improving the characteristics.

Figure 3:
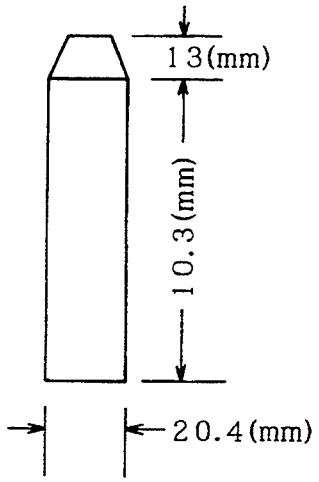
FIGS. 3 (*a*), (*b*) and (*c*) show the dimensions of an antenna with a short tapered surface at the top end portion and its characteristic.
Figure 3:
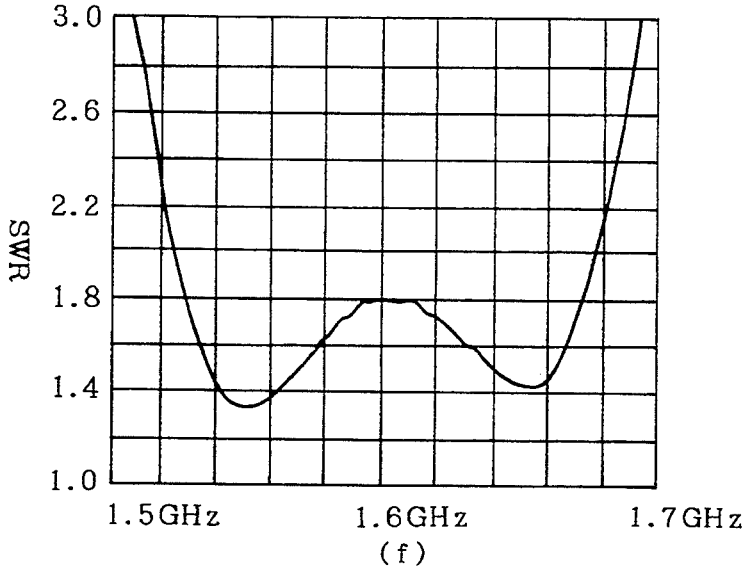
Figure 3:
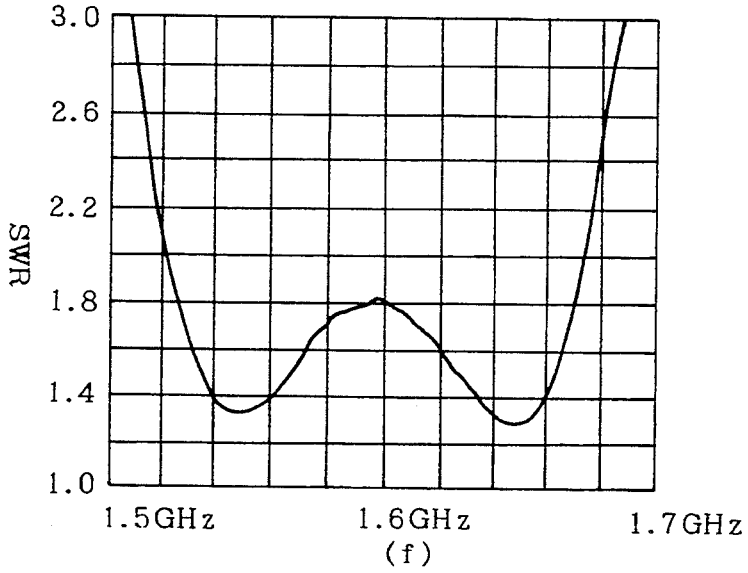

For example, the antenna shown in FIG. 3 (*a*) has a comparatively short tapered portion formed only at the top end, which has the characteristics shown in FIGS.

3 (*b*) and (*c*) . The characteristics are improved as compared with those of the conventional antenna, though the characteristic in FIG. 3 (*b*) is slightly deteriorated at the upper limit frequency.

Figure 4:
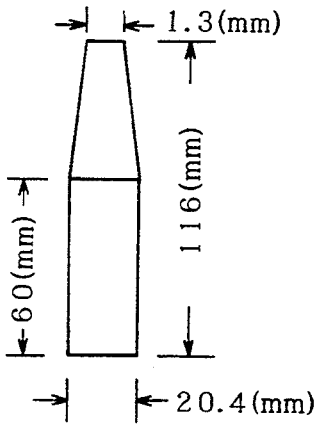
FIGS. 4 (*a*), (*b*) and (*c*) show the dimension of an antenna with a larger tapered surface at the top end portion and its characteristic.
Figure 4:
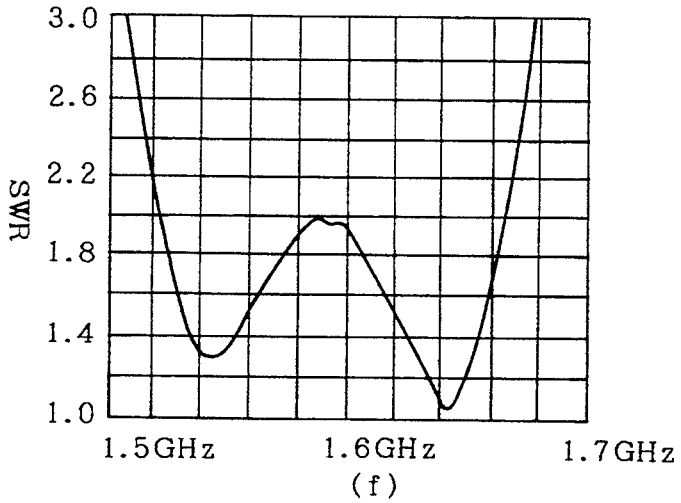
Figure 4:
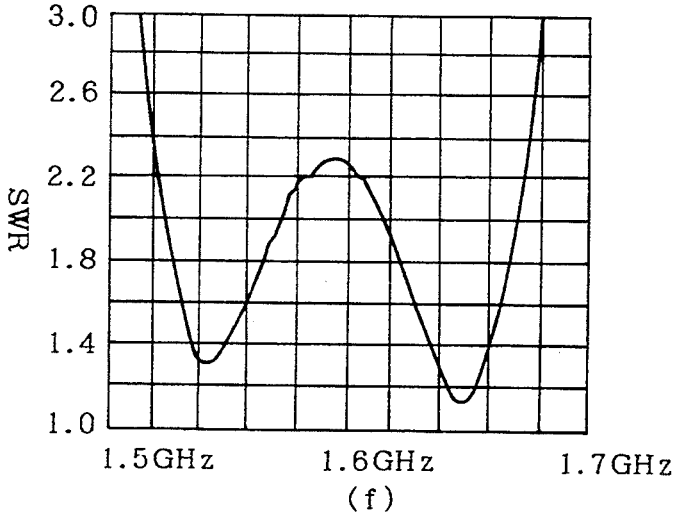

The antenna shown in FIG. 4 (*a*) has the same form as the above antenna with a tapered portion extended longer. This antenna has the characteristics shown in FIGS. 4 (*b*) and (*c*) similar to those in FIG. 3.

Figure 5:
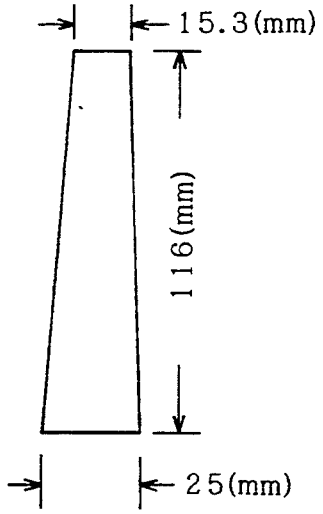
FIGS. 5 (*a*), (*b*) and (*c*) show dimensions of an antenna with a single cylinder or cylindrical tube the overall length of which being slightly tapered and its characteristic.
Figure 5:
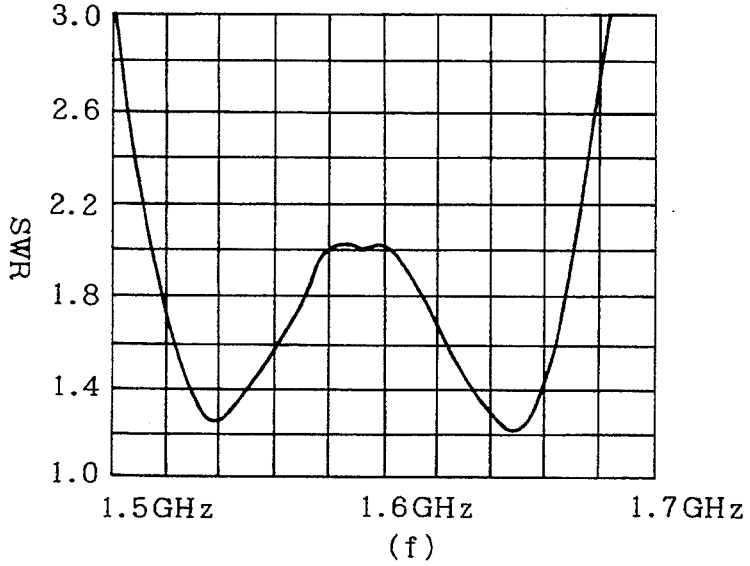
Figure 5:
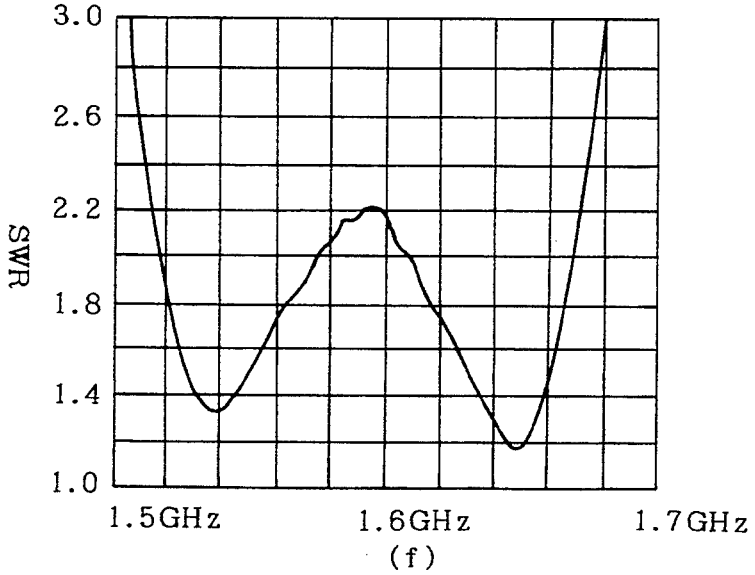

Further, the antenna shown in FIG. 5 (*a*) has a cylinder or cylindrical tube slightly tapered over the whole length. A general improvement is also noticeable in the characteristics of this form of antenna as shown in FIGS. (*b*) and (*c*), as compared with those of the conventional antenna.

The characteristics shown in (*b*) and (*c*) of FIGS. 3, 4 and 5 are also the SWRs measured at the two input terminals of the balun, as those in FIG. 2.

Figure 6:
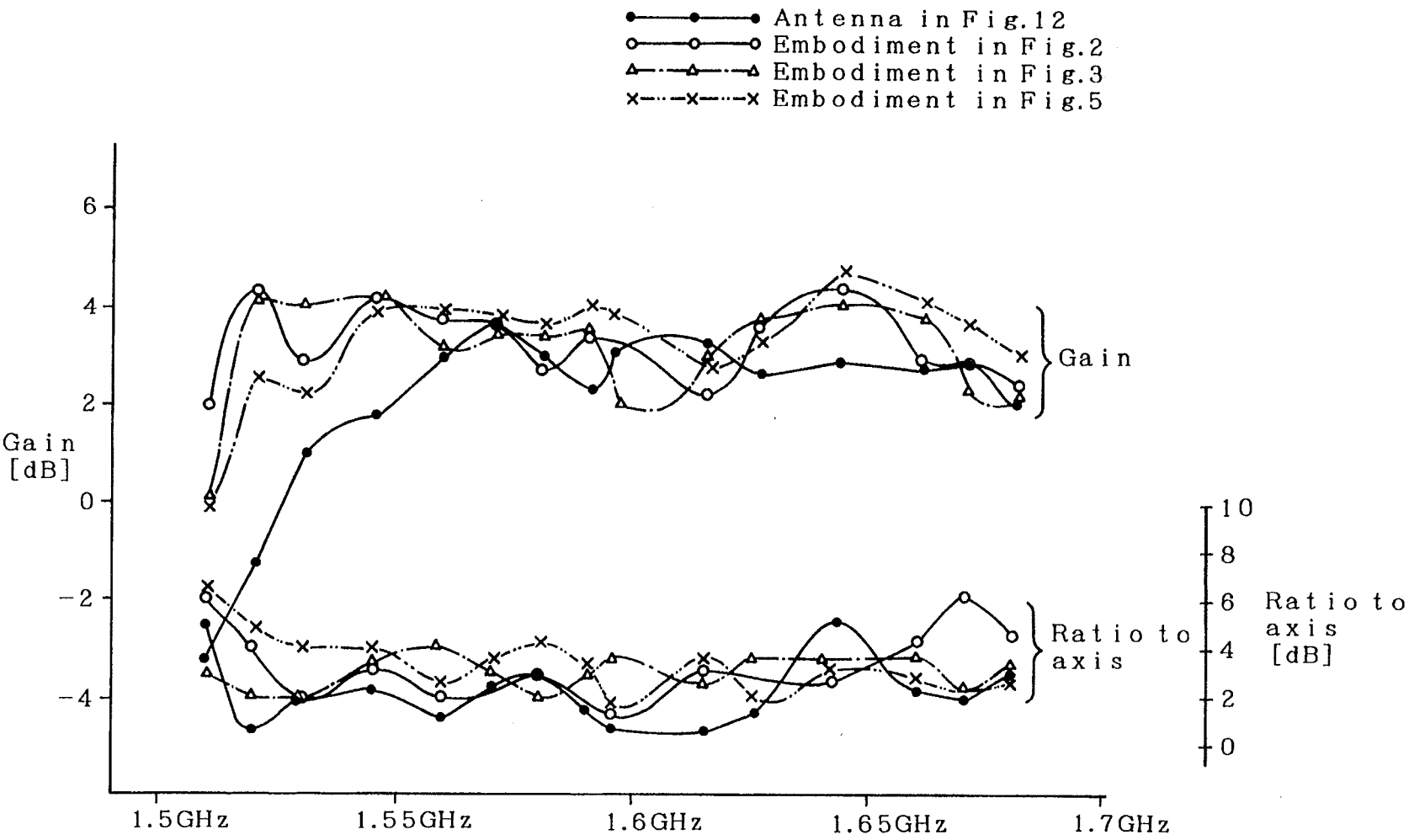
FIG. 6 shows the frequency characteristic of the gain and the ratio-to-axis (axial ratio) of the embodiments of the 4-wire fractional-winding helical antenna of the present invention.
Figure 12:
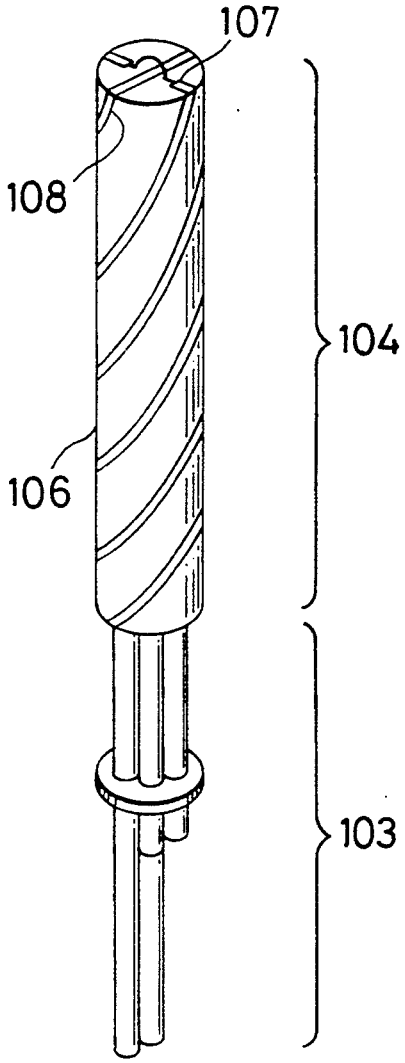
Fig. 12 (PRIOR ART)
FIG. 12 is a perspective view of a conventional 4-wire fractional-winding helical antenna.
Figure 13:
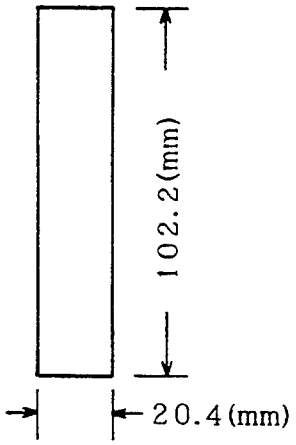
Fig. 13 (a) (PRIOR ART)
FIGS. 13 (*a*) , (*b*) and (*c*) show dimensions of a conventional straight-cylinder 4-wire fractional-winding helical antenna and the SWRs measured at the two input-side terminals of a balun.
Figure 13:
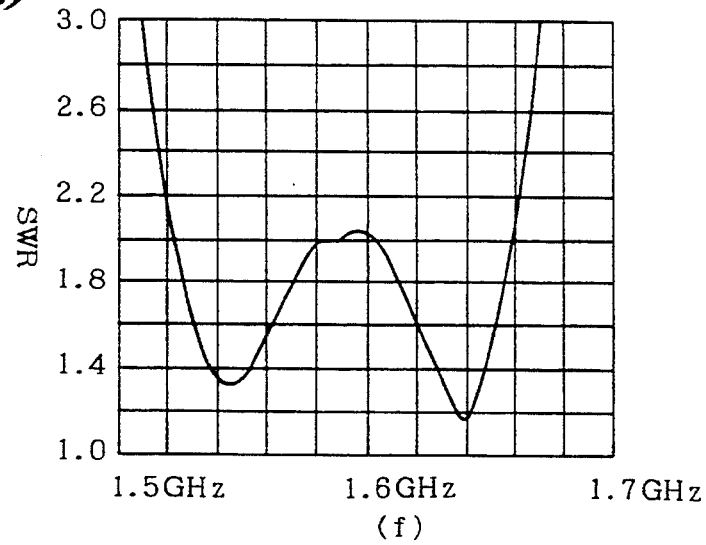
Fig. 13 (b) (PRIOR ART)
Figure 13:
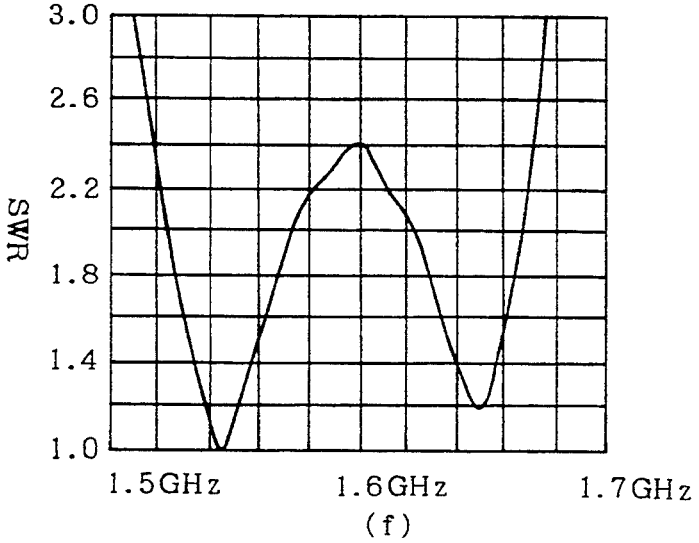
Fig. 13 (c) (PRIOR ART)
Figure 14:
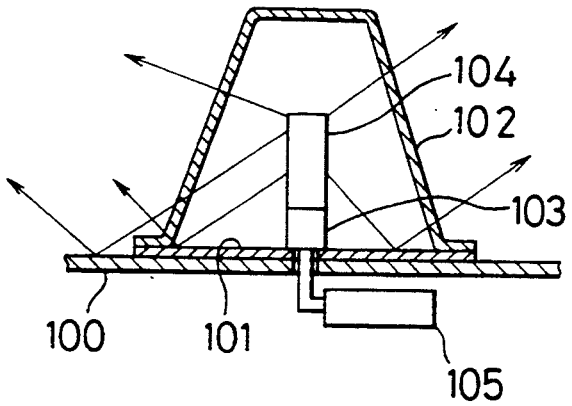
Fig. 14 (PRIOR ART)
FIG. 14 is a cross-section of an example of a conventional 4-wire fractional-winding helical antenna unit.

The frequency characteristic of the gain and that of the ratio-to-axis of the above embodiments of the 4-wire fractional-winding helical antenna of the present invention are shown in FIG. 6 for reference. To make it easy to compare with the characteristic of a conventional antenna, that of the conventional cylinder antenna in FIGS. 12 and 13 is also shown.

A significant improvement in the gain is also noticeable from FIG. 6.

Although an embodiment of two cylinders or cylindrical tubes of different diameters connected is shown in the above description, the present invention is not limited to that embodiment, but three or more cylinders or cylindrical tubes of gradually increased different diameters may also be connected. Further, the members as shown in FIGS. 4 and 5 may be connected.

As other dimensions other than those shown in Figures are dependent on the characters of the supporting material (dielectric constant, etc.), they are appropriately determined so that the characteristics of the antenna become desirable over the intended frequency bands.

Next described is the method for forming the conductor pattern on the surface of the cylinder or cylindrical tube of the 4-wire fractional-winding helical antenna described above and other forms of the supporting member.

Figure 7:
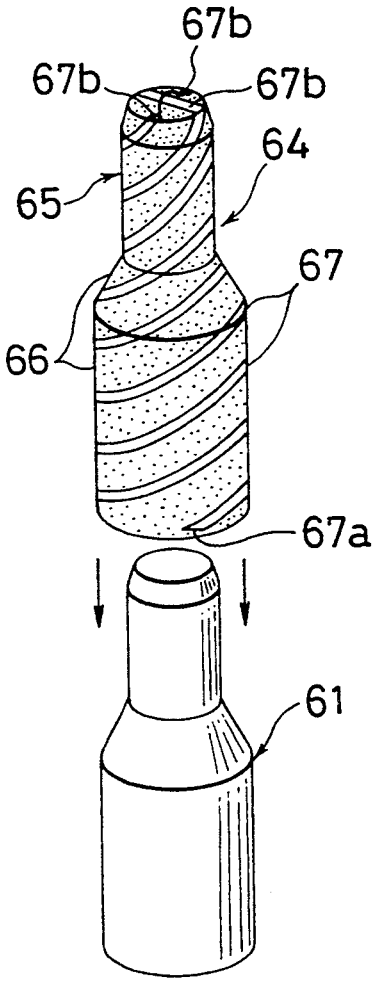
FIG. 7 shows a mask used for putting the method of the present invention into practice and the method for forming a conductor pattern with the mask.

FIG. 7 shows a mask used for putting the method of the present invention into practice and the method of forming the conductor pattern using the mask. The mask 64 shown is for forming the helical antenna pattern on the side surface of a teflon stepped cylinder (antenna supporting member) 61 with cylindrical portions of different outer diameters.

The mask 64 is in the form of a sheath 65 whose inner surface fits closely to the outer surface of the stepped cylindrical member 61. The sheath 65 is made of a transparent thin sheet such as resins. The larger-diameter bottom end of the sheath 65 is opened so that the mask can be fitted on the antenna supporting member 61 by simply putting the mask on the member 61 from the top end as shown in FIG. 7. The sheath 65 has helical transparent parts 67 corresponding to the antenna pattern to be formed on the outer surface of the stepped cylinder 61 left in the opaque ground 66.

When forming the conductors in the top end of the cylindrical member, transparent parts 67*b* are formed in the top end of the mask with one of them broken to form a gap to pass the other. The top end of the sheath 65 may be opened. Bottom portion 67*a* of the transparent parts 67 will provide a connection to other circuitry.

The process of forming an antenna pattern using the above mask 64 is as follows.

First, the surface of the Teflon stepped cylinder 61 is roughed with a chemical agent. This roughing of the surface of the member 61 is to increase the adhesion strength of a metal layer formed at the next step. Next, a metal layer is formed uniformly on the surface of the member 61 by evaporation or electroless plating and a photoresist is applied to the metal layer in a darkroom. Then the mask 64 is fitted on the member 61.

While rotating the member 61 along with the mask 64, the photoresist is irradiated with the light to which it is sensitive. The photoresist under the transparent parts 67 is thereby exposed to the light and cures. The exposure may also be carried out without rotating the member 61 by irradiating light from all around the member 61.

Next, the mask 64 is removed from the member 61. Then unexposed photoresist is removed with a chemical agent such as sodium thiosulfate and further the metal layer under the removed unexposed photoresist is removed by an etching agent.

Finally, the exposed and cured photoresist is washed out to uncover the metal layer left in the form of the antenna pattern.

This etching process thus can form the antenna pattern easily and very precisely on a stepped cylindrical member and hence makes a mass production with a reduced cost possible.

Further, this etching method using the above mask can be applied not only to a stepped cylinder but also to cylinder, cone, and other solid bodies. To any solid body, this etching process can be carried out easily by making a mask in the form of a sheath which fits closely to the outer surface of the supporting member.

A preferable method for making the mask is cutting a resin sheet into the developed shape of the mask, making the ground 66 opaque leaving transparent parts 67 corresponding to the antenna pattern, and then forming the sheet into a sheath 65.

The sheath may be further hot-molded using a mold in the same form as the supporting member 61 to make the sheath fit closely to the supporting member 61 as those with tapered portions.

Since the 4-wire fractional-winding helical antenna of the first embodiment of the present invention has a usable broader frequency bands, it makes easy simultaneous transmission and reception through distant frequency bands with one antenna.

Furthermore, as the conductor pattern required for the above 4-wire fractional-winding helical antenna of the present invention can be formed easily and very precisely on the surface of cylinder, cylindrical tube, and particularly a stepped cylinder of gradually increased different diameters by the method of the present invention, the method is very effective for a mass production with a reduced cost of the 4-wire fractional-winding helical antenna of the present invention.

Figure 8:
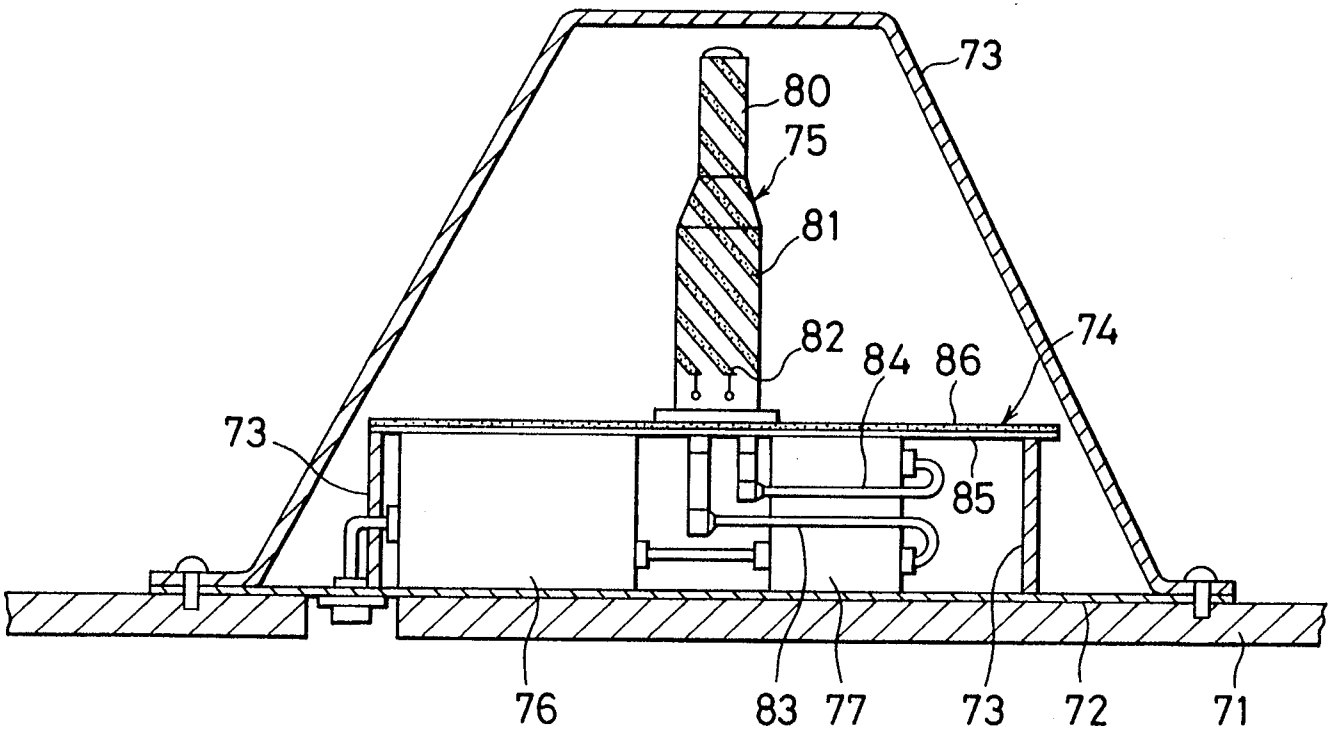
FIG. 8 is a cross-section of a 4-wire fractional-winding helical antenna unit of the present invention.
Figure 9:
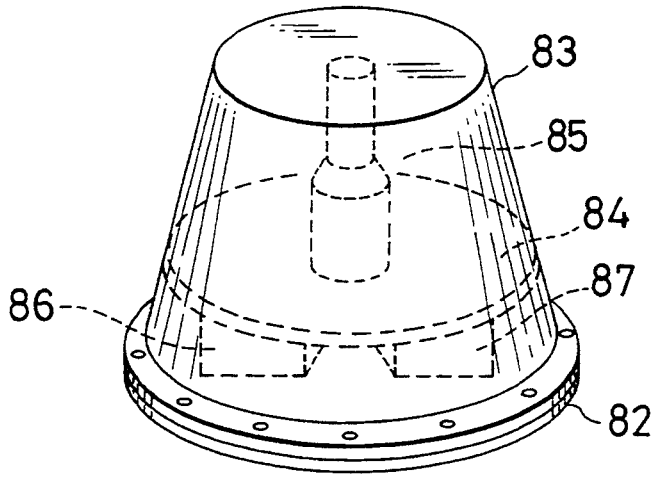
FIG. 9 is a perspective view of the antenna unit shown in FIG. 8.

FIG. 8 shows a cross section of an antenna unit as the second embodiment of the present invention. FIG. 9 is the perspective view of the antenna unit.

This antenna unit is so constructed as to be fixed to the airframe 71 of an aircraft and comprises an aluminum base plate 72, a shield plate 74 supported on members 73 perpendicular to the base plate 72 spaced apart from the base plate 72, an antenna 75 mounted on the shield plate 74, and a hybrid circuit (HYB) 76 and a balun 77 disposed on the base plate 72 beneath the shield plate 74.

The antenna body 75 comprises a mylar supporting member 80 and two antenna elements 81 and 82 in the form of narrow strips. The bottom ends of one antenna element are connected to the balun 77 through a semirigid cable 83 and those of the other antenna element are connected to the balun 77 through a semirigid cable 84.

The antenna 75 comprises a supporting member 80 and two antenna elements 81 and 82 in the form of narrow strips wound helically around the supporting member 80. The bottom ends of these antenna elements 81 and 82 are connected to the balun 77 by means of semirigid cables 83 and 84.

The antenna 75 may be the type as shown in FIG. 1 and FIG. 2 (*a*). It may also be the type as shown in FIG. 3 (*a*), FIG. 4 (*a*) or FIG. 5 (*a*).

The shield plate 74 comprises an aluminum plate 85, for example, and a layer of an electromagnetic wave absorbing material 86 such as ferrite coated over the top face of the aluminum plate 85.

Since the shield plate 74 is provided between the antenna 75 and the coupling and conversion circuits such as the hybrid circuit 76 and the balun 77, the electromagnetic wave radiated from the antenna 75 toward the base plate 72 and the airframe 71 in the vicinity of the antenna unit is absorbed by the layer 86 and consequently the bad influence of reflected wave on the directional pattern is significantly reduced.

Further, a conductive plate 85 such as aluminum provides the shielding effect of electric field between the antenna 75 and the coupling and conversion circuits such as the hybrid circuit 76 and the balun 77.

Figure 10:
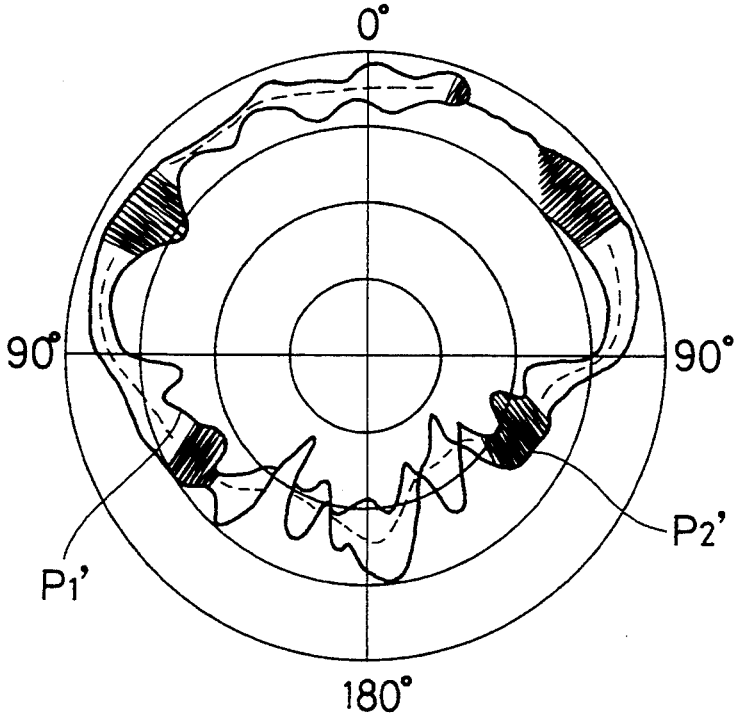
FIG. 10 is the radiation pattern of the 4-wire fractional-winding helical antenna unit of the present invention.
Figure 11:
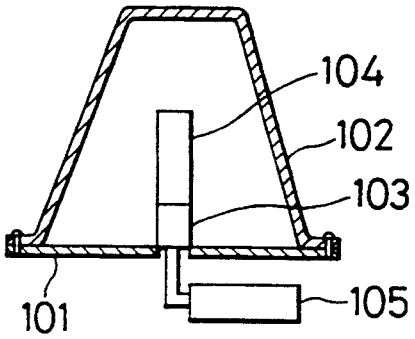
Fig. 11 (PRIOR ART)
FIG. 11 is a cross-section of a conventional 4-wire fractional-winding helical antenna unit.
Figure 15:
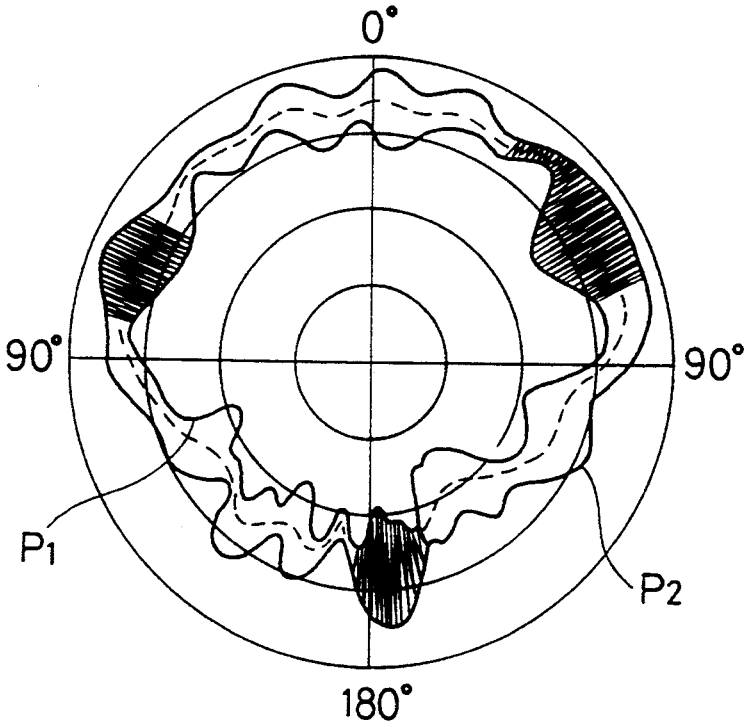
Fig. 15 (PRIOR ART)
FIG. 15 is the radiation pattern of the 4-wire fractional-winding helical antenna unit shown in FIG. 14.

FIG. 10 shows the gain in the perpendicular direction of the radiation pattern of the 4-wire fractional-winding helical antenna unit of the present invention. The difference between the inner radiation pattern P1′ which connects the minimum value of the gain in each direction and the outer radiation pattern P2′ which connects the maximum value of the gain in each direction is smaller and the whole form of the radiation pattern is nearer to a circle compared with that in FIG. 15. It is thus known that the radiation characteristics of the antenna unit is significantly improved.

When the transmission signal is output from the transceiver, two signals with a predetermined phase difference are generated from the signal and fed to the balun 77. When the two received signals are output from the balun 77, these signals are combined into one and sent to the transceiver.

The balun 77 is a part for an unbalanced-balanced conversion between the hybrid circuit 76 and the antenna 75

When the electromagnetic wave from the antenna mixes with the signals in the hybrid circuit 76 and the balun 77, the function of these circuits can be disturbed to cause the increase of SWR and the lowering of the antenna efficiency and hence a deterioration of the directional pattern. However, since the antenna unit of the second embodiment of the present invention has the shield plate 74 provided between the antenna 75 and the circuits 75 and 76, the electromagnetic wave radiated toward the antenna base and the airframe is absorbed by the shield plate 74 and the above problem is prevented.

As described above, the second embodiment of the present invention can prevent the deterioration of the directional pattern caused by a part of the electromagnetic wave radiated from the antenna being reflected by the components at the antenna base and the airframe and the lowering of the antenna performance caused by the electromagnetic wave mixing with the signals in the circuits at the antenna base.

What is claimed is:

1. A 4-wire helical antenna unit comprising:

a 4-wire helical antenna having a base portion, said 4-wire helical antenna comprising cylindrical portions having different diameters coaxially connected by a tapered portion to form an antenna supporting member having a conductor pattern formed on the surface thereof;

coupling and conversion circuits; and a shield plate having an area greater than the cross-sectional area of the base portion of said antenna; wherein an antenna-side face of said shield plate is provided with a layer of material for absorbing electromagnetic waves, and wherein said shield plate is disposed between said base portion and said circuits.

2. A 4-wire helical antenna unit as claimed in claim 1, in which said antenna supporting member has two ends, wherein one end comprises a tapered end portion.

3. A 4-wire helical antenna element comprising:

an antenna supporting member made of a dielectric material, having first and second cylindrical portions and first and second tapered portions, said first tapered portion being provided at a top end of said first cylindrical portion, and said second tapered portion being provided between said first and second cylindrical portions, said second cylindrical portion having a greater diameter than said first cylindrical portion, and said first and second cylindrical portions formed so as to be coaxially aligned with each other; and a plurality of conductors, each comprising a metal helical winding formed on a surface of said antenna supporting member, each said helical winding completing less than two turns about said antenna supporting member.

* * * * *